US010539048B2

(12) United States Patent
McCloy et al.

(10) Patent No.: US 10,539,048 B2
(45) Date of Patent: Jan. 21, 2020

(54) HYDRAULIC LOCK FOR ELECTRICALLY-ACTUATED CAMSHAFT PHASERS

(71) Applicant: BorgWarner Inc., Auburn Hills, MI (US)

(72) Inventors: Chad McCloy, Cortland, NY (US); Braman Wing, Ithaca, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 92 days.

(21) Appl. No.: 15/710,097

(22) Filed: Sep. 20, 2017

(65) Prior Publication Data

US 2019/0085734 A1 Mar. 21, 2019

(51) Int. Cl.
*F01L 1/344* (2006.01)
*F01L 1/352* (2006.01)

(52) U.S. Cl.
CPC ..... *F01L 1/3442* (2013.01); *F01L 1/352* (2013.01); *F01L 2001/34459* (2013.01)

(58) Field of Classification Search
CPC ..... F01L 1/3442; F01L 1/352; F01L 2001/34459; F01L 2820/032; F01L 1/34; Y02T 10/6239
USPC ..... 123/90.17, 90.15
See application file for complete search history.

(56) References Cited

U.S. PATENT DOCUMENTS 5,410,994 A * 5/1995 Schechter ..... F01L 9/02 123/90.12
6,263,846 B1 7/2001 Simpson et al.
8,893,677 B2 11/2014 Smith
8,899,199 B1 12/2014 Waters
9,046,013 B2 6/2015 Lichti
9,080,471 B2 7/2015 Pluta et al.
9,376,940 B2 6/2016 Fischer et al.
9,410,453 B2 8/2016 Rollinger et al.
2006/0236967 A1* 10/2006 Gregor ..... F01L 1/344 123/90.17
2007/0144476 A1* 6/2007 Eichenberg ..... F01L 1/352 123/90.17
2007/0169731 A1* 7/2007 Farah ..... F01L 1/352 123/90.17

(Continued)

FOREIGN PATENT DOCUMENTS

CN 103485852 B 1/2014
JP 2010133272 6/2010

(Continued)

*Primary Examiner* — Mark A Laurenzi
*Assistant Examiner* — Wesley G Harris
(74) *Attorney, Agent, or Firm* — Reising Ethington P.C.

(57) ABSTRACT

A variable camshaft timing device that adjusts phase between a camshaft and a crankshaft includes a planetary gear assembly that changes an angular position of the camshaft relative to an angular position of the crankshaft; a sun gear configured to receive an output shaft of an electric motor that rotates at least a portion of the planetary gear assembly and controls phase adjustment between the camshaft and crankshaft by angularly displacing the camshaft with respect to the crankshaft; and a hydraulic lock (82) that releasably engages a portion of the variable camshaft timing device (10) in response to force applied by pressurized fluid thereby selectively preventing rotation of the camshaft relative to the crankshaft.

16 Claims, 5 Drawing Sheets

(56) References Cited

U.S. PATENT DOCUMENTS

| | | | | |
|---|---|---|---|---|
| 2008/0153603 | A1* | 6/2008 | Gregor | F01L 1/34 464/1 |
| 2013/0019825 | A1* | 1/2013 | Fischer | F01L 1/352 123/90.15 |
| 2015/0377087 | A1 | 12/2015 | Koo | |
| 2016/0130988 | A1 | 5/2016 | Smith et al. | |
| 2016/0348759 | A1* | 12/2016 | McCloy | F16H 1/2863 |
| 2017/0145874 | A1* | 5/2017 | Wing | F01L 1/024 |

FOREIGN PATENT DOCUMENTS

| | | | | |
|---|---|---|---|---|
| JP | 2010242531 | A | 10/2010 | |
| JP | 2013253589 | A | 12/2013 | |
| WO | WO-2006119463 | A1 * | 11/2006 | F01L 1/3442 |

* cited by examiner

HYDRAULIC LOCK FOR ELECTRICALLY-ACTUATED CAMSHAFT PHASERS

TECHNICAL FIELD

The present application relates to electrically-actuated camshaft phasers and, more particularly, to a hydraulic lock that selectively controls camshaft phase through the electrically-actuated camshaft phaser.

BACKGROUND

Internal combustion engines include camshafts that open and close valves regulating the combustion of fuel and air within combustion chambers of the engines. The opening and closing of the valves are carefully timed relative to a variety of events, such as the injection of fuel into the combustion chamber for combustion, the location of the piston relative to top-dead center (TDC), and the rotational speed of the crankshaft to name a few. Camshaft(s) are driven by the rotation of the crankshaft via a drive member connecting these elements, such as a belt or chain.

In the past, a fixed relationship existed between the rotation of the crankshaft and the rotation of the camshaft. However, internal combustion engines increasingly use variable camshaft timing (VCT) to vary the phase of camshaft rotation relative to crankshaft rotation. VCT can be carried out by camshaft phasers that are actuated and controlled by an electric motor having an output shaft that regulates the phase relationship of the camshaft relative to the crankshaft. An electric motor controller can direct the electric motor regulating the cam phaser to change the phase between the camshaft and the crankshaft using a rotational position and/or speed of the output shaft. That is, depending on the design of the camshaft phaser, the electric motor can reduce or increase the rotational speed of the output shaft to thereby retard or advance the phase between the camshaft and the crankshaft. Apart from changing phase, the electric motor of the camshaft phaser may be directed by the electric motor controller to maintain a particular phase relationship between the camshaft and the crankshaft.

However, maintaining a phase relationship between the camshaft and the crankshaft using an electrically-actuated camshaft phaser may be challenging. A control system determines whether the camshaft phaser is maintaining a desired phase relationship between the camshaft and the crankshaft. Such a determination may involve receiving a position signal from a crankshaft sensor and a position signal from a camshaft signal and detecting, based on data from these signals, whether any angular drift exists between the camshaft and crankshaft and, if so, directing the electric motor to adjust the phase. Doing so involves maintaining the control system, sensors, and electric motor in an active state. It would be helpful to control the phase between the camshaft and the crankshaft without regard to the operational state of the control system, the sensors, and/or the electric motor of an electrically-actuated cam phaser.

SUMMARY

In one embodiment, a variable camshaft timing device that adjusts phase between a camshaft and a crankshaft includes a planetary gear assembly that changes an angular position of the camshaft relative to an angular position of the crankshaft; a sun gear configured to receive an output shaft of an electric motor that rotates at least a portion of the planetary gear assembly and controls phase adjustment between the camshaft and crankshaft by angularly displacing the camshaft with respect to the crankshaft; and a hydraulic lock that releasably engages a portion of the variable camshaft timing device in response to force applied by pressurized fluid thereby selectively preventing rotation of the camshaft relative to the crankshaft.

In another embodiment, a variable camshaft timing device that adjusts phase between a camshaft and a crankshaft includes a first ring gear configured to receive rotational input from the crankshaft and rotate about a center axis, having a plurality of radially-inwardly facing gear teeth; a second ring gear, axially spaced from the first ring gear, configured to connect to the camshaft and rotate about the center axis, having a plurality of radially-inwardly facing gear teeth; a planetary gear assembly engaged with the first ring gear and the second ring gear and positioned radially inwardly from the first ring gear and the second ring gear; an electric motor having an output shaft that rotates the planetary gear assembly and controls phase adjustment between the camshaft and crankshaft by angularly displacing the first ring gear with respect to the second ring gear; and a plate, axially adjacent to the planetary gear assembly, having a hydraulic lock that releasably engages a portion of the planetary gear assembly thereby selectively preventing rotation of the planetary gear assembly relative to the plate.

DETAILED DESCRIPTION

A camshaft phaser that is controlled or actuated with an electric motor but using a hydraulically-controlled lock can maintain a phase relationship between a camshaft and a crankshaft without input or assistance from a control system, the electric motor, and/or position sensors that detect the angular position of the camshaft or crankshaft. In the past, camshaft phasers controlled/actuated by electric motors (also sometimes referred to as ePhasers) typically used engine oil solely for lubrication. However, the proposed ePhaser can use pressurized liquid lubricant, such as engine oil, to selectively engage a locking element that mechanically locks the angular position of the camshaft relative to the angular position of the crankshaft. The locking element can be carried by a portion of the ePhaser that is in fluid communication with an oil supply of an internal combustion engine (ICE) and releasably-biased into locking engagement with an adjustment mechanism of the camshaft phaser in response to the absence, presence, or pressure variation of the supplied oil.

For example, the locking element can be forced by a biasing member into locking engagement with the adjustment mechanism, such as a planetary gear assembly, so that a fixed phase is maintained between the camshaft and the crankshaft. A valve can selectively permit the flow of pressurized oil from the oil supply to the locking element such that opening the valve permits pressurized oil to move the locking element and disengage the adjustment mechanism thereby overcoming the force exerted by the biasing member. This allows the camshaft to be angularly displaced with respect to the crankshaft in response to control from an output shaft of the electric motor controlling the camshaft phaser. When the valve is later closed, oil is prevented from reaching the locking element allowing the biasing member to move the locking member into locking engagement with the adjusting mechanism.

Figure 1:
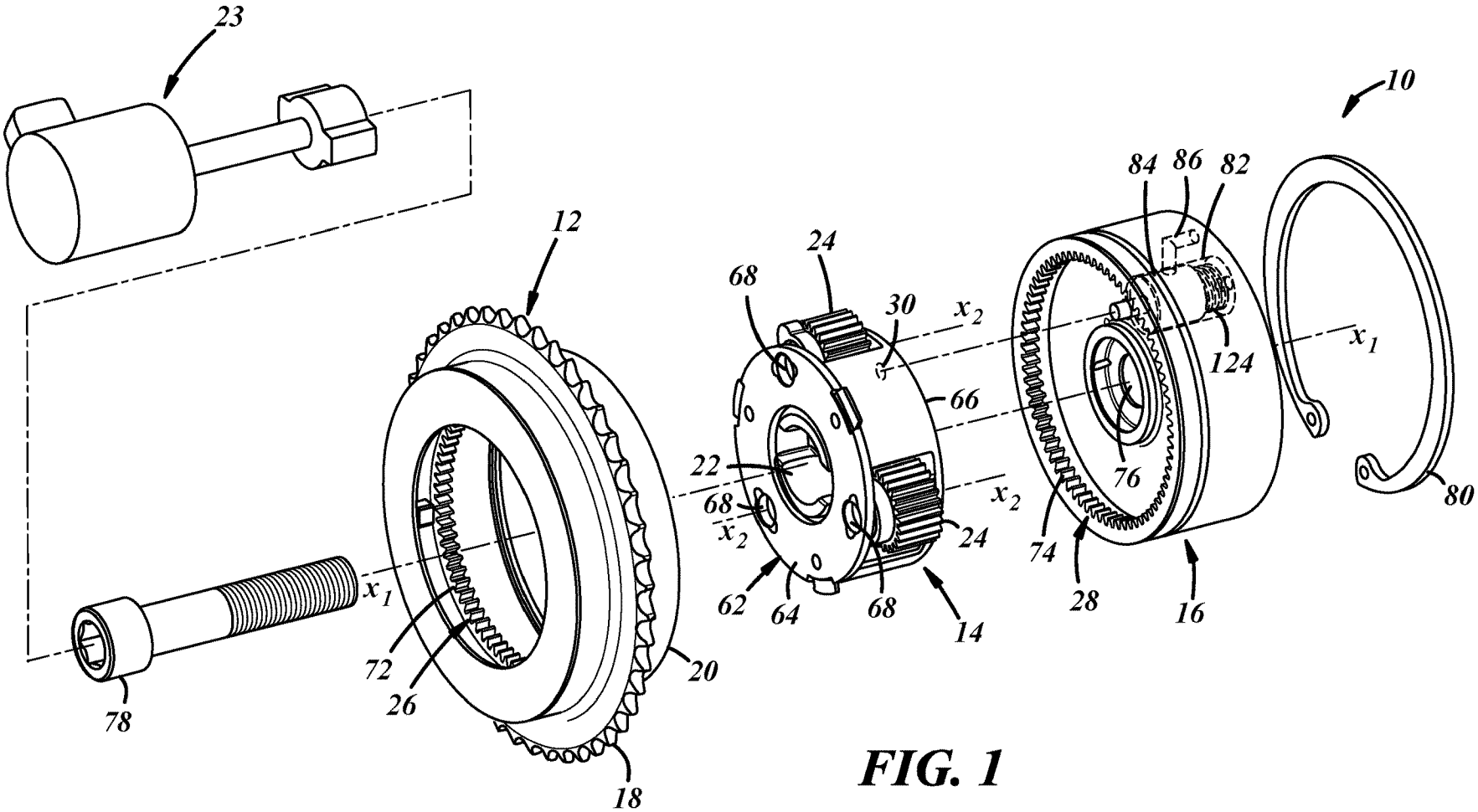
FIG. 1 is an exploded view depicting an implementation of a camshaft phaser with a hydraulic lock.
Figure 2:
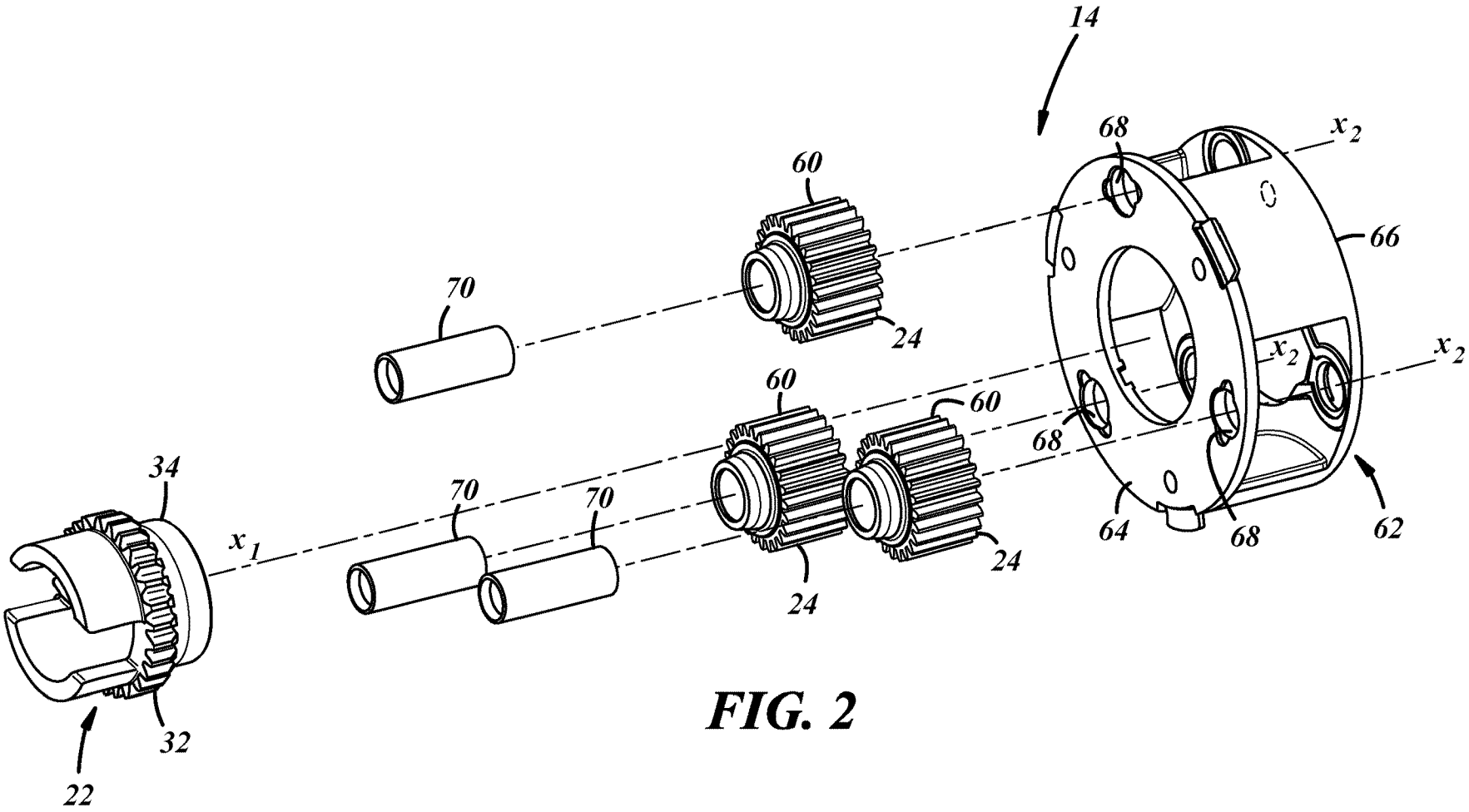
FIG. 2 is an exploded view depicting a portion of an implementation of a camshaft phaser with a hydraulic lock.
Figure 3:
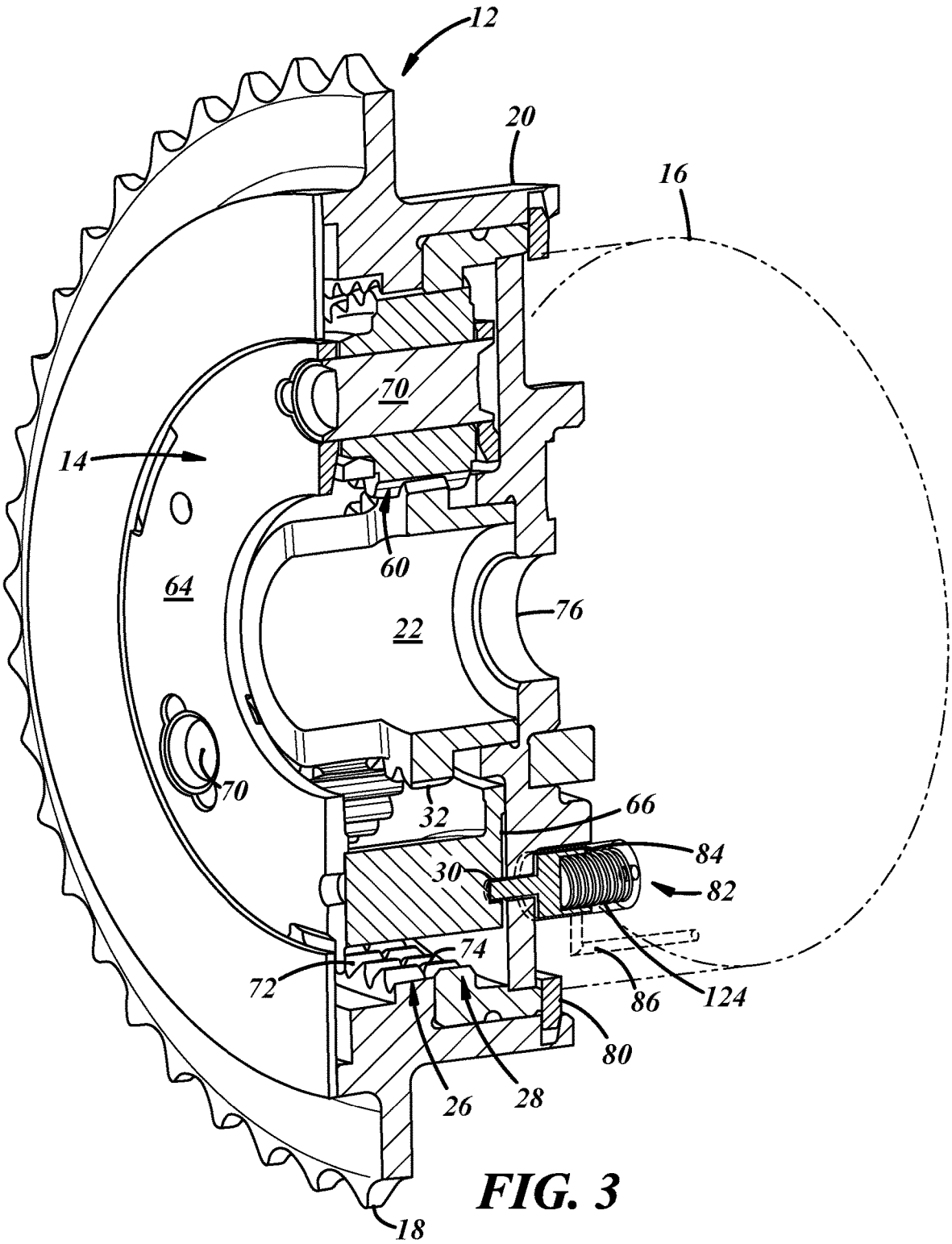
FIG. 3 is a sectional view depicting a portion of an implementation of a camshaft phaser with a hydraulic lock.

An embodiment of a camshaft phaser 10 that can incorporate the hydraulically-controlled lock is shown with respect to FIGS. 1-3. The phaser 10 is a multi-piece mechanism with components that work together to transfer rotation from the engine's crankshaft and to the engine's camshaft, and that can work together to angularly displace the camshaft relative to the crankshaft for advancing and retarding engine valve opening and closing. The phaser 10 can have different designs and constructions depending upon, among other possible factors, the application in which the phaser is employed and the crankshaft and camshaft that it works with. In the embodiment presented in FIGS. 1-3, for example, the phaser 10 includes a sprocket 12, a planetary gear assembly 14, and an inner plate or plate 16.

The sprocket 12 receives rotational drive input from the engine's crankshaft and rotates about an axis $X_1$. A timing chain or a timing belt can be looped around the sprocket 12 and around the crankshaft so that rotation of the crankshaft translates into rotation of the sprocket 12 via the chain or belt. Other techniques for transferring rotation between the sprocket 12 and crankshaft are possible. Along an outer surface, the sprocket 12 has a set of teeth 18 for mating with the timing chain, with the timing belt, or with another component. In different examples, the set of teeth 18 can include thirty-eight individual teeth, forty-two individual teeth, or some other quantity of teeth spanning continuously around the circumference of the sprocket 12. As illustrated, the sprocket 12 has a housing 20 spanning axially from the set of teeth 18. The housing 20 is a cylindrical wall that surrounds parts of the planetary gear assembly 14.

In the embodiment presented here, the planetary gear assembly 14 includes a sun gear 22, planet gears 24, a first ring gear 26, a second ring gear 28, and a lock receiver 30. The sun gear 22 is driven by an electric motor 23 for rotation about the axis $X_1$. The sun gear 22 engages with the planet gears 24 and has a set of teeth 32 at its exterior that makes direct teeth-to-teeth meshing with the planet gears 24. In different examples, the set of teeth 32 can include twenty-six individual teeth, thirty-seven individual teeth, or some other quantity of teeth spanning continuously around the circumference of the sun gear 22. A skirt 34 in the shape of a cylinder spans from the set of teeth 32. As described, the sun gear 22 is an external spur gear, but could be another type of gear. The lock receiver 30 can be a socket or other type of aperture for engaging with the hydraulic lock and preventing the rotational movement of the planetary gear assembly 14 with respect to the inner plate 16. The lock receiver 30 is shown in the figures as part of the planetary gear assembly 14 but could be located elsewhere in other embodiments. This will be discussed in more detail below.

The planet gears 24 rotate about their individual rotational axes $X_2$ when in the midst of bringing the engine's camshaft among advanced and retarded angular positions. When not advancing or retarding, the planet gears 24 revolve together around the axis $X_1$ with the sun gear 22 and with the ring gears 26, 28. In the embodiment presented here, there are a total of three discrete planet gears 24 that are similarly designed and constructed with respect to one another, but there could be other quantities of planet gears such as two or four or six. However many there are, each of the planet gears 24 can engage with both of the first and second ring gears 26, 28, and each planet gear can have a set of teeth 60 along its exterior for making direct teeth-to-teeth meshing with the ring gears. In different examples, the teeth 60 can include twenty-one individual teeth, or some other quantity of teeth spanning continuously around the circumference of each of the planet gears 24. To hold the planet gears 24 in place and support them, a carrier assembly 62 can be provided. The carrier assembly 62 can have different designs and constructions. In the embodiment presented in the figures, the carrier assembly 62 includes a first carrier plate 64 at one end, a second carrier plate 66 at the other end, and cylinders 68 that serve as a hub for the rotating planet gears 24. Planet pins or bolts 70 can be used with the carrier assembly 62.

The first ring gear 26 receives rotational drive input from the sprocket 12 so that the first ring gear 26 and sprocket 12 rotate together about the axis $X_1$ in operation. The first ring gear 26 can be a unitary extension of the sprocket 12—that is, the first ring gear 26 and the sprocket 12 can together form a monolithic structure. The first ring gear 26 has an annular shape, engages with the planet gears 24, and has a set of teeth 72 at its interior for making direct teeth-to-teeth meshing with the planet gears 24. In different examples, the teeth 72 can include eighty individual teeth, or some other quantity of teeth spanning continuously around the circumference of the first ring gear 26. In the embodiment presented here, the first ring gear 26 is an internal spur gear, but could be another type of gear.

The second ring gear 28 transmits rotational drive output to the engine's camshaft about the axis $X_1$. In this embodiment, the second ring gear 28 drives rotation of the camshaft via the plate 16. The second ring gear 28 and plate 16 can be connected together in different ways, including by a cutout-and-tab interconnection, press-fitting, welding, adhering, bolting, riveting, or by another technique. In embodiments not illustrated here, the second ring gear 28 and the plate 16 could be unitary extensions of each other to make a monolithic structure. Like the first ring gear 26, the second ring gear 28 has an annular shape, engages with the planet gears 24, and has a set of teeth 74 at its interior for making direct teeth-to-teeth meshing with the planet gears. In different examples, the teeth 74 can include seventy-seven individual teeth, or some other quantity of teeth spanning continuously around the circumference of the second ring gear 28. With respect to each other, the number of teeth between the first and second ring gears 26, 28 can differ by a multiple of the number of planet gears 24 provided. So, for instance, the teeth 72 can include eighty individual teeth, while the teeth 74 can include seventy-seven individual teeth—a difference of three individual teeth for the three planet gears 24 in this example. In another example with six planet gears, the teeth 72 could include seventy individual teeth, while the teeth 74 could include eighty-two individual teeth. Satisfying this relationship furnishes the advancing and retarding capabilities by imparting relative rotational movement and relative rotational speed between the first and second ring gears 26, 28 in operation. In the embodiment presented here, the second ring gear 28 is an internal spur gear, but could be another type of gear. The plate 16 includes a central aperture 76 through which a center bolt 78 passes to fixedly attach the plate 16 to the camshaft. In addition, the plate 16 is also be secured to the sprocket 12 with a snap ring 80 that axially constrains the planetary gear assembly 14 between the sprocket 12 and the plate 16.

The plate 16 includes a hydraulic lock 82 in fluid communication with an oil supply (not shown) that selectively engages the hydraulic lock 82 to prevent the relative angular motion between the planetary gear assembly 14 and the plate 16, which also prevents angular motion between these elements relative to the sprocket 12. The oil supply can be provided by an oil pump of the ICE that pressurizes oil obtained from an input tube located in an oil sump (not shown) and conveys the oil to various locations within the ICE, such as the crankshaft bearing journals, input/output valves, the camshaft, and the hydraulic lock 82, to name a few. The hydraulic lock 82 can include a locking element 84 that is opposably biased by a lock biasing member into sliding engagement with the lock receiver 30. The lock receiver 30 positively engages the locking element 84 to prevent the relative rotational motion between the camshaft and the crankshaft. Pressurized oil can be received by the hydraulic lock 82 via a phaser fluid passageway 86. The oil can be provided to the hydraulic lock 82 through a fluid passage within the camshaft that receives oil from the oil supply and communicates the pressurized oil with the phaser fluid passageway 86.

Figure 4:
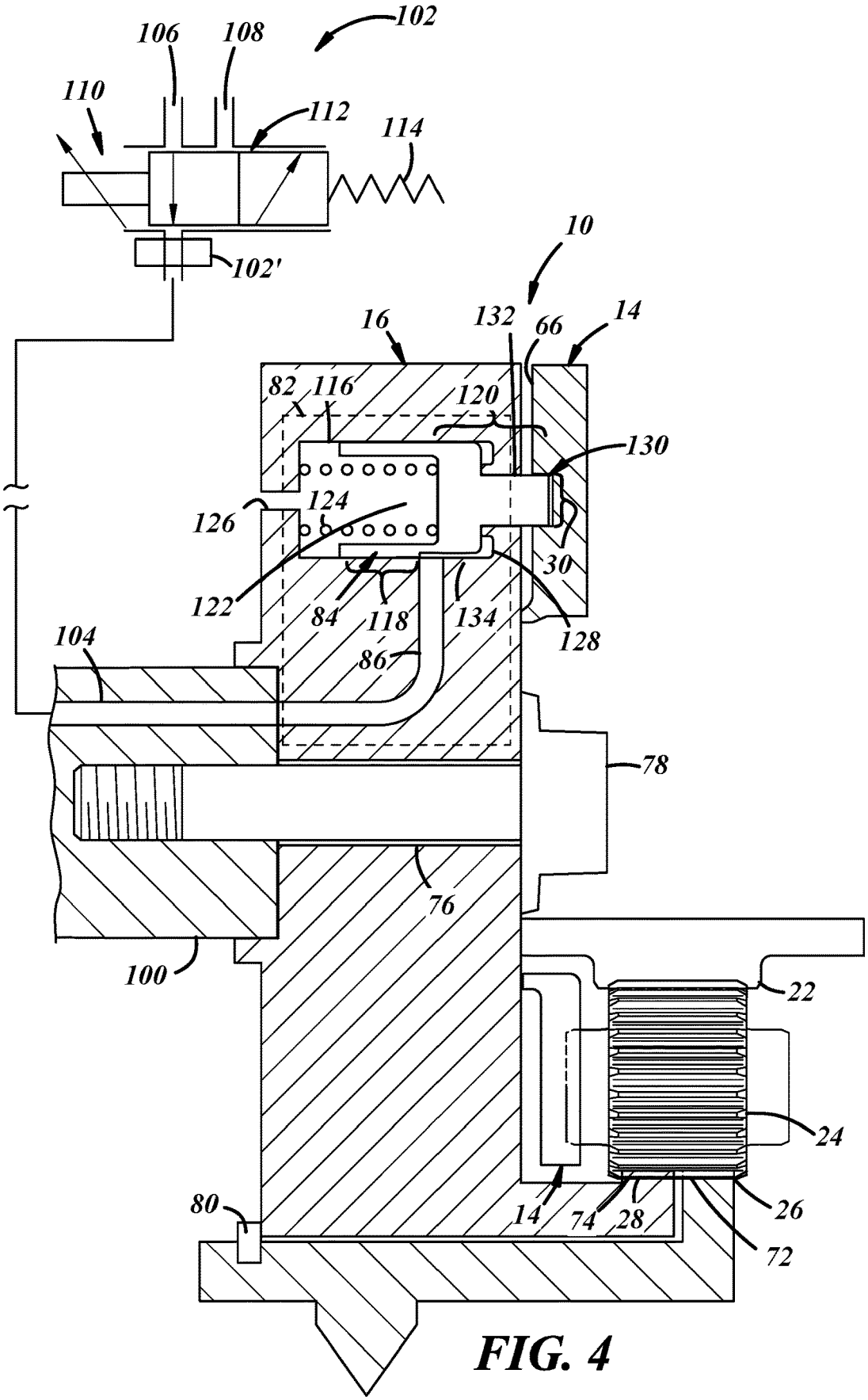
FIG. 4 is a sectional view depicting a portion of an implementation of a camshaft phaser with a hydraulic lock.

A valve 102, shown in FIG. 4, can control the flow of pressurized oil to the hydraulic lock 82 thereby selectively controlling the position of the locking element 84. The flow of pressurized oil can slide the locking element 84 away from the planetary gear assembly 14 and toward the plate 16 compressing the lock biasing member 124 so that the locking element 84 disengages with the lock receiver 30 allowing the sprocket 12 and the plate 16 to have relative angular motion relative to each other. And when the valve 102 stops the flow of pressurized oil to the hydraulic lock 82, the lock biasing member slidably moves the locking element 84 toward the planetary carrier assembly 14 and away from the plate 16 into locking engagement with the lock receiver 30. These elements and the functionality of the hydraulic lock 74 will be discussed below in more detail.

Together, the two ring gears 26, 28 constitute a split ring gear construction for the planetary gear assembly 14. However, other implementations of electrically-controlled camshaft phasers could be used with the hydraulic lock. For example, the planetary gear assembly 14 could include more than two ring gears such as an additional third ring gear for a total of three ring gears. Here, the third ring gear could also transmit rotational drive output to the engine's camshaft like the second ring gear 28, and could have the same number of individual teeth as the second ring gear.

Turning to FIG. 4, a sectional view of a portion of the camshaft phaser 10 is shown attached to a camshaft 100 and in fluid communication with a valve 102 that controls the flow of pressurized oil to the hydraulic lock 82. In this embodiment, the valve 102 controls the flow of pressurized oil from the oil sump of the ICE through a camshaft fluid passage 104 that communicates with the phaser fluid passageway 86. The valve 102 can include an oil supply passage 106 and a vent 108 as well as a solenoid 110 that slidably moves a valve stem 112 between open and closed positions. A pressure regulator 102' can be included with the valve 102 to reduce oil pressure exerted on the hydraulic lock 84. The pressure regulator 102' can reduce oil consumption as oil pressure increases. The valve stem 112 can be biased by a biasing member 114 into a closed position blocking the flow of pressurized oil from the oil source to the hydraulic lock 82. As a voltage is applied to the solenoid 110, an armature of the solenoid 110 can linearly slide the valve stem 112 toward the biasing member 114 overcoming the force exerted by the biasing member 114 and fluidly connecting the oil supply passage 106 with the camshaft fluid passage 104. Pressurized oil is then received by the hydraulic lock 82. When the voltage is removed from the solenoid 110, the biasing member 114 slides the valve stem 112 toward the solenoid 110 and closes the fluid connection between the oil supply passage 106 and the camshaft fluid passage 104. The valve 102 can be located remotely from the camshaft phaser 10 and the ICE. This is shown in FIG. 4 using the broken line between the valve 102 and the camshaft fluid passage 104. A number of unidentified fluid passages can exist between the valve 102 and the camshaft fluid passage 104 to convey the pressurized oil depending on the implementation.

The hydraulic lock 82 is fluidly connected with the phaser fluid passageway 86 and includes a lock cylinder 116 within which the locking element 84 slides between a locked position and an unlocked position. The locking element 84 can include a biasing end 118 and a locking end 120. The biasing end 118 includes a recessed portion 122 to receive one end of a lock biasing member 124 while the other end of the member 124 abuts an inside surface of the lock cylinder 116 forcing the locking element 84 toward the planetary gear assembly 14. The biasing end 118 can extend the entire width or diameter of the lock cylinder 116 such that an external surface of the locking element 84 abuts and slides against an inner surface of the lock cylinder 116. The abutting relationship can prevent the flow of pressurized oil of the phaser fluid passageway 86 from reaching the lock biasing member 124. The lock cylinder 116 can include a vent 126 that receives ambient air helping permit the axial movement of the valve stem 112. The locking end 120 includes a shoulder 128 and a locking pin 130. The shoulder 128 can be annularly shaped and defined by the diameter of the locking pin 130 and an outer diameter of the locking element 84. The locking pin 130 can extend through an opening 132 to extend beyond the plate 16 and engage with the lock receiver 30 in the planetary gear assembly 14. The lock cylinder 116 includes a fluid chamber 134 that can be in fluid communication with the phaser fluid passageway 86 and defined at least partially by the locking end 120.

In a locked position, the lock biasing member 124 opposably biases the locking element 84 into engagement with the lock receiver 30 of the planetary gear assembly 14 through the opening 132. This can occur in the absence of pressurized oil from the phaser fluid passageway 86 as would occur when the valve 102 is closed. The locking element 84 can axially slide within the lock cylinder 116 toward the planetary gear assembly 14. Depending on the angular position of the camshaft relative to the crankshaft, the locking pin 130 may slide against the second carrier plate 68 until the locking pin 130 passes over the lock receiver 30 in alignment with the opening 132 so that the pin 130 can slide further away from the plate 16 and into engagement with the receiver 30.

The locking element 84 can be moved to an unlocked position in response to the introduction of pressurized oil into the fluid chamber 134. Opening the valve 102 releases pressurized oil into the camshaft fluid passage 104 and the phaser fluid passageway 86 where it ultimately reaches the fluid chamber 134. The force exerted by the pressurized oil on the shoulder 128 is greater than the force applied to the biasing end 118 by the biasing member 124. The locking pin 130 slides away from the lock receiver 30 and planetary gear assembly 14 compressing the biasing member 124 in response to the receipt of pressurized oil. When the valve 102 closes, the pressure exerted on the shoulder 128 is eased and the locking element 84 is once again biased toward the planetary gear assembly 14 so that the lock receiver can receive the locking pin 130.

The opening and closing of the valve 102 and operation of the electric phaser motor can be controlled by a control system. The control system can include one or more processors, a memory device that includes computer-readable memory, and an input/output device for receiving sensor data from one or more sensors and transmitting computer-readable instructions from the control system to various types of hardware, such as the electric phaser motor 23 and the valve 102. The processor can be any type of device capable of processing electronic instructions including microprocessors, microcontrollers, host processors, controllers, vehicle communication processors, and application specific integrated circuits (ASICs). It can be a dedicated processor used only for controlling the electric phaser motor 23 and or valve 102 or can be shared with other vehicle systems. The processor executes various types of digitally-stored instructions, such as software or firmware programs stored in memory the memory device, which enable the camshaft phaser to operate. The sensors can include a camshaft position sensor and a crankshaft position sensor. The input/output can be linked to the electric phaser motor 23, the valve 102, and/or the sensors in any one of a variety of network connections, such those carried out using a vehicle bus. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

The control system can command the electric phaser motor to change or maintain the relative angular position between the camshaft and crankshaft. When the hydraulic lock 82 is disengaged, the control system can receive input from a camshaft position sensor and a crankshaft position sensor and command the electric phaser motor 23 to advance, retard, or maintain the phase between the camshaft and the crankshaft based on this sensor input. Typically, the control system stays operational during vehicle operation to maintain camshaft phase and prevent drift that can be caused by cam torque changes as the ICE starts or stops. However, the activation of the hydraulic lock 82 can permit the camshaft phaser 10 to maintain a relative angular position or phase between the camshaft and crankshaft without receiving commands from the control system and deactivate of the control system for periods of time while the ICE is still operational. This may reduce power consumption by the electric phaser motor and/or the control system.

Given that an activated hydraulic lock prevents relative movement between the camshaft and crankshaft, less lubricity may be needed to preserve the gears during operation. It is possible to end a lubricating oil supply to the camshaft phaser using the same valve that controls the hydraulic lock. For instance, when the valve opens, pressurized oil can disengage the hydraulic lock and also begin supplying oil to lubricate the camshaft phaser while relative angular motion is possible between the camshaft and the crankshaft. And when the valve closes, pressurized oil is no longer supplied to the camshaft phaser and the lack of pressurized oil engages the hydraulic lock to prevent relative angular motion between the camshaft and the crankshaft. It should be appreciated that the camshaft phaser 10 is only one embodiment of a camshaft phaser and hydraulic lock. Apart from what is described above, camshaft phasers that include electric motors and hydraulic locks can be implemented in a variety of different ways.

Figure 5:
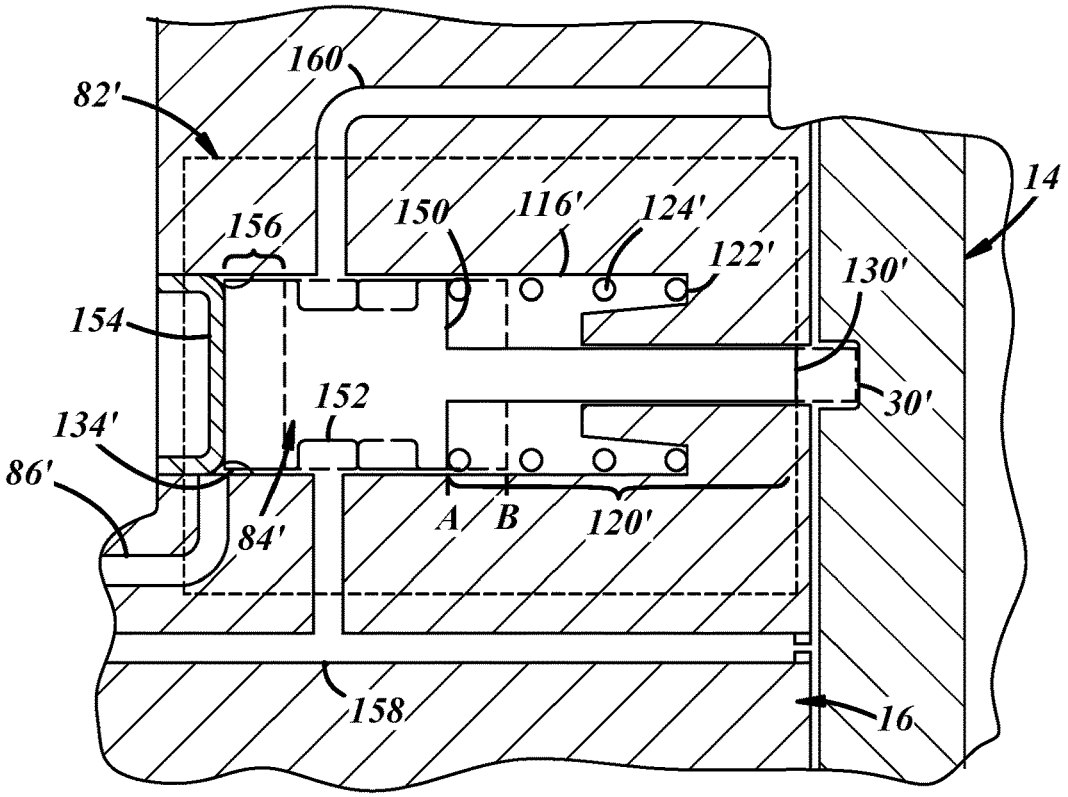
FIG. 5 is a sectional view depicting a portion of another implementation of a camshaft phaser with a hydraulic lock.

Hydraulic locks can also be used to control lubrication provided to electrically-controlled camshaft phasers as well. For example, a supply of pressurized oil used to lubricate the gears of the camshaft phaser 10 can be stopped when the hydraulic lock is activated. FIG. 5 depicts another implementation of the hydraulic lock 82' that is biased in the unlocked position and also controls the flow of pressurized engine oil to the camshaft phaser 10. In this implementation, the hydraulic lock 82' includes a lock cylinder 116' within which the locking element 84' slides between an unlocked position and a locked position. The locking element 84' can include a lock biasing shoulder 150 and a locking end 120'. The lock cylinder 116' includes a recessed portion 122' to receive one end of a lock biasing member 124' while the other end of the member 124' abuts the lock biasing shoulder 150 forcing the locking element 84 away from the planetary gear assembly 14 into an unlocked position (A). The locking element 84' can extend the entire width or diameter of the lock cylinder 116' such that an external surface of the locking element 84' abuts and slides against an inner surface of the lock cylinder 116'. During assembly, the locking element 84' can axially slide into the lock cylinder 116' and be secured in place with a plug 154 that securely fits into one end of the lock cylinder 116'. The locking element 84' includes a fluid end 156 that, along with the plug 154, defines a fluid chamber 134' that receives pressurized engine oil from a phaser fluid passageway 86'. In some implementations, the fluid end 156 can have a portion that is reduced in diameter such that the portion does not have a diameter extending to touch the inner surface of the lock cylinder 116'. The reduced diameter portion would then increase the size of the fluid chamber 134'. The pressurized engine oil can communicate with the phaser fluid passageway 86' and be controlled by a valve as is discussed above.

In addition, the locking element 84' can include an annular groove 152 that controls a flow of lubricating fluid, such as engine oil, to the cam phaser 10 depending on the axial position of the locking element 84'. The annular groove 152 selectively communicates pressurized engine oil from an oil supply passageway 158 to a phaser lubrication passageway 160. In an unlocked position (A), the lock biasing member 124' opposably biases the locking element 84' away from and out of engagement with a lock receiver 30' of the planetary gear assembly 14. This occurs in the absence of pressurized engine oil from the phaser fluid passageway 86' as would occur when the valve 102 is closed. While in the unlocked position, the annular groove 152 permits the flow of pressurized engine oil to the camshaft phaser 10 through the phaser lubrication passageway 160. The locking element 84' can be moved into a locked position (B) in response to opening the valve 102 and introducing pressurized engine oil into the fluid chamber 134' via the phaser fluid passageway 86'. The force exerted by the pressurized oil on the fluid end 156 is greater than the force applied to the lock biasing shoulder 150 by the biasing member 124'. The locking pin 130' slides toward a lock receiver 30' and planetary gear assembly 14 compressing the biasing member 124' in response to the receipt of pressurized oil. In addition, the annular groove 152 moves axially so that it no longer permits the flow of pressurized engine oil from the oil supply passageway 158 to the phaser lubrication passageway 160 while the locking element 84' is in the locked position (B). When the valve 102 closes, the pressure exerted on the fluid end 156 is eased and the locking element 84' is once again biased away from the planetary gear assembly 14.

Figure 6:
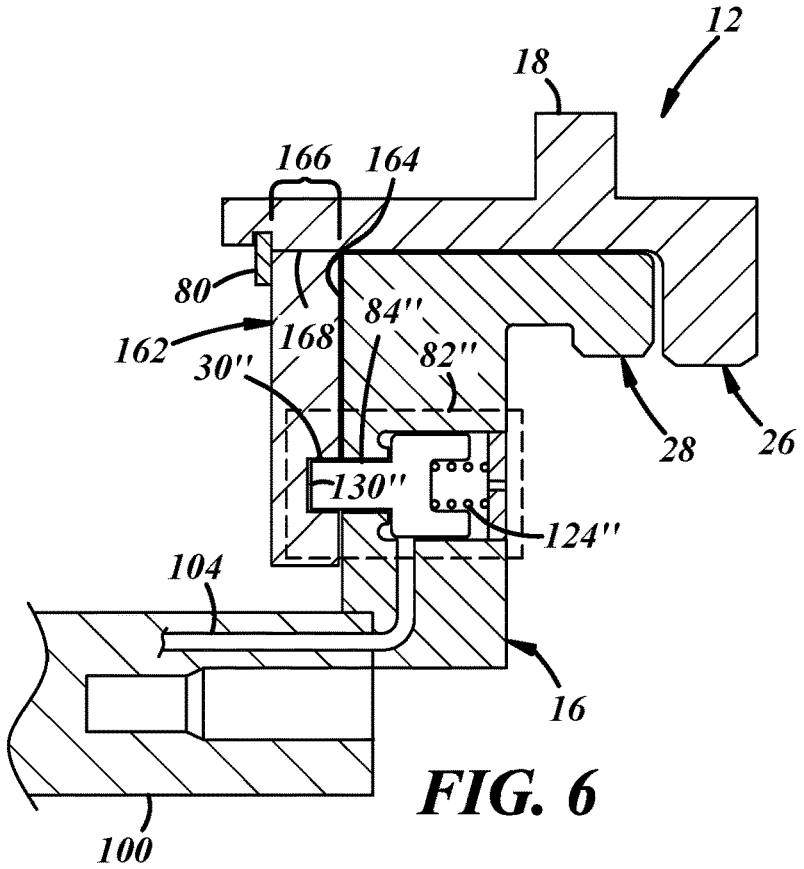
FIG. 6 is a sectional view depicting a portion of another implementation of a camshaft phaser with a hydraulic lock.

FIG. 6 depicts another embodiment of the hydraulic lock as it can be incorporated into the camshaft phaser 10. In this embodiment, a hydraulic lock 82" is included in the inner plate 16 and selectively engages a housing 162 of the camshaft phaser 10. The hydraulic lock 82" includes a locking element 84" that is biased into a locking position by a lock biasing member 124". The housing 162 can be an annular element that abuts a side of the inner plate 16 nearest the camshaft 100 and away from the second ring gear 28. The snap ring 80 can keep the housing 162 and the inner plate 16 axially constrained with respect to the sprocket 12. And the housing 162 can be rotationally constrained with respect to the sprocket 12 using an inwardly facing locking surface 166, such as a spline or keyed connection, that engages a radially outward surface 168 of the housing 162. In this implementation, the locking element 84" functions much like the locking element 84 described above with respect to FIG. 4. However, it should be appreciated that rather than a locking pin engaging a planetary gear assembly from an inner plate the locking pin engages the housing from the inner plate.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing device (10) that adjusts phase between a camshaft and a crankshaft, comprising:

a planetary gear assembly (14) that changes an angular position of the camshaft relative to an angular position of the crankshaft;

a sun gear (22) configured to receive an output shaft of an electric motor (23) that rotates at least a portion of the planetary gear assembly (14) and controls phase adjustment between the camshaft and crankshaft by angularly displacing the camshaft with respect to the crankshaft; and a hydraulic lock (82) that releasably engages a portion of the variable camshaft timing device (10) in response to force applied by pressurized fluid thereby selectively preventing rotation of the camshaft relative to the crankshaft, wherein the hydraulic lock (82') controls a flow of pressurized oil used to lubricate gears of the variable camshaft timing device (10).

2. The variable camshaft timing device of claim 1, wherein a plate (16), axially adjacent to the planetary gear assembly (14), includes the hydraulic lock (82) and one or more fluid passages (86) communicating fluid from a fluid source to the hydraulic lock (82).

3. The variable camshaft timing device of claim 1, further comprising a valve (102) that selectively directs fluid to the hydraulic lock (82).

4. The variable camshaft timing device of claim 3, further comprising a solenoid (110) that controls the valve (102).

5. The variable camshaft timing device of claim 3, further comprising a pressure regulator (102') that limits a pressure of the pressurized fluid.

6. The variable camshaft timing device of claim 1, wherein the hydraulic lock (82) further comprises a locking pin (130) that axially slides into engagement with the portion of the planetary gear assembly (14).

7. The variable camshaft timing device of claim 1, wherein a locking pin (130) is biased into engagement with a lock receiver (30) of the planetary gear assembly (14).

8. The variable camshaft timing device of claim 1, wherein the pressurized fluid is oil from an internal combustion engine.

9. A variable camshaft timing device (10) that adjusts phase between a camshaft and a crankshaft, comprising:

a first ring gear (26) configured to receive rotational input from the crankshaft and rotate about a center axis ($X_1$), having a plurality of radially-inwardly facing gear teeth (72);

a second ring gear (28), axially spaced from the first ring gear (26), configured to connect to the camshaft and rotate about the center axis ($X_1$), having a plurality of radially-inwardly facing gear teeth (74);

a planetary gear assembly (14) engaged with the first ring gear (26) and the second ring gear (28) and positioned radially inwardly from the first ring gear (26) and the second ring gear (28);

an electric motor having an output shaft that rotates the planetary gear assembly (14) and controls phase adjustment between the camshaft and crankshaft by angularly displacing the first ring gear (26) with respect to the second ring gear (28);

a plate (16), axially adjacent to the planetary gear assembly (14), having a hydraulic lock (82) that releasably engages a portion of the planetary gear assembly (14) thereby selectively preventing rotation of the planetary gear assembly (14) relative to the plate (16), wherein the hydraulic lock (82') controls a flow of pressurized fluid used to lubricate gears of the variable camshaft timing device (10).

10. The variable camshaft timing device of claim 9, wherein the plate (16) includes one or more fluid passages (86) communicating fluid from a fluid source to the hydraulic lock (82).

11. The variable camshaft timing device of claim 9, further comprising a valve (102) that selectively directs fluid to the hydraulic lock (82).

12. The variable camshaft timing device of claim 11, further comprising a solenoid (110) that controls the valve (102).

13. The variable camshaft timing device of claim 11, further comprising a pressure regulator (102') that limits a pressure of the pressurized fluid.

14. The variable camshaft timing device of claim 9, wherein the hydraulic lock (82) further comprises a locking pin (130) that axially slides into engagement with the portion of the planetary gear assembly (14).

15. The variable camshaft timing device of claim 14, wherein the locking pin (130) is biased into engagement with a lock receiver (30) of the planetary gear assembly (14).

16. The variable camshaft timing device of claim 9, wherein the pressurized fluid is oil from an internal combustion engine.

* * * * *